US008598993B2

(12) United States Patent
Rodriguez et al.

(10) Patent No.: US 8,598,993 B2
(45) Date of Patent: Dec. 3, 2013

(54) METHOD FOR WIRING DEVICES IN A STRUCTURE USING A WIRELESS NETWORK

(75) Inventors: Yan Rodriguez, Suwannee, GA (US); Thomas Bennett, III, Wooster, OH (US)

(73) Assignee: Homerun Holdings Corporation, Pensacola, FL (US)

( * ) Notice: Subject to any disclaimer, the term of this patent is extended or adjusted under 35 U.S.C. 154(b) by 817 days.

(21) Appl. No.: 12/192,333

(22) Filed: Aug. 15, 2008

(65) Prior Publication Data

US 2010/0039240 A1 Feb. 18, 2010

(51) Int. Cl.
*G08C 19/12* (2006.01)

(52) U.S. Cl.
USPC ..... 340/13.24; 340/13.25; 340/12.22; 340/12.38; 340/4.11; 340/815.6

(58) Field of Classification Search
USPC ..... 340/310.11, 13.24, 13.25, 12.38, 4.11, 340/815.6, 12.22
See application file for complete search history.

(56) References Cited

U.S. PATENT DOCUMENTS 4,165,443 A * 8/1979 Figart et al. ..... 174/53
4,355,309 A * 10/1982 Hughey et al. ..... 340/9.16
4,889,999 A * 12/1989 Rowen ..... 307/31
4,980,806 A 12/1990 Taylor et al.
4,995,053 A 2/1991 Simpson et al.
5,189,412 A * 2/1993 Mehta et al. ..... 340/12.24
5,194,858 A * 3/1993 Erwin ..... 340/12.11
5,239,205 A * 8/1993 Hoffman et al. ..... 307/117
5,270,698 A * 12/1993 Hoyle et al. ..... 340/815.9
5,340,954 A * 8/1994 Hoffman et al. ..... 200/277.2
5,445,539 A * 8/1995 Dale ..... 439/535
5,458,311 A * 10/1995 Holbrook ..... 248/309.1
5,528,229 A * 6/1996 Mehta ..... 340/3.4
5,738,496 A * 4/1998 Mehta ..... 417/44.1
5,814,950 A * 9/1998 Carson et al. ..... 315/317
5,872,832 A * 2/1999 Bishel et al. ..... 379/39
5,905,442 A * 5/1999 Mosebrook et al. ..... 340/3.7
6,021,033 A * 2/2000 Benham et al. ..... 361/42
6,120,262 A 9/2000 McDonough
6,262,653 B1 * 7/2001 Pietriferno ..... 340/331
6,365,989 B1 * 4/2002 O'Donnell ..... 307/42
6,969,954 B2 11/2005 Lys
7,078,925 B2 * 7/2006 Long ..... 324/762.01
7,167,777 B2 1/2007 Budike
7,190,126 B1 3/2007 Paton
7,251,570 B2 7/2007 Hancock et al.
7,394,367 B1 * 7/2008 Aupperle et al. ..... 340/540
7,692,904 B2 * 4/2010 Li et al. ..... 361/45
7,767,905 B2 * 8/2010 Meyer ..... 174/60
7,848,852 B2 * 12/2010 Sakae et al. ..... 700/276
7,955,096 B2 * 6/2011 Arenas et al. ..... 439/107
2002/0085251 A1 * 7/2002 Ofek et al. ..... 359/117
2002/0185296 A1 * 12/2002 Schultz et al. ..... 174/53
2003/0016129 A1 1/2003 Menard et al.

(Continued)

*Primary Examiner* — Benjamin C Lee
*Assistant Examiner* — Quang D Pham
(74) *Attorney, Agent, or Firm* — Baker & Hostetler LLP

(57) ABSTRACT

The present invention provides a method for controlling lighting fixtures over a wireless network that includes connecting a junction box to a power source, connecting a lighting fixture to the junction box, establishing a connection over a wireless network between the junction box and a controller, and controlling a function of the lighting fixture by transmitting a signal from the controller to the junction box over the wireless network.

17 Claims, 3 Drawing Sheets

(56) References Cited

U.S. PATENT DOCUMENTS

| | | | | |
|---|---|---|---|---|
| 2003/0037212 | A1* | 2/2003 | Capps et al. | 711/163 |
| 2003/0070572 | A1* | 4/2003 | Tang | 102/349 |
| 2003/0107399 | A1* | 6/2003 | Bailis et al. | 326/38 |
| 2003/0191874 | A1* | 10/2003 | Drescher et al. | 710/38 |
| 2005/0184915 | A1* | 8/2005 | Nagel et al. | 343/702 |
| 2006/0097890 | A1* | 5/2006 | Atkins | 340/825.72 |
| 2006/0215345 | A1 | 9/2006 | Huizenga | |
| 2007/0120653 | A1 | 5/2007 | Paton | |
| 2007/0189675 | A1* | 8/2007 | Nagatsuka | 385/88 |
| 2008/0143270 | A1* | 6/2008 | Sun et al. | 315/219 |
| 2008/0231464 | A1* | 9/2008 | Lewis et al. | 340/825 |
| 2008/0303661 | A1* | 12/2008 | Chick | 340/541 |
| 2009/0052122 | A1* | 2/2009 | Johnson et al. | 361/643 |
| 2009/0053926 | A1* | 2/2009 | Johnson et al. | 439/535 |
| 2009/0101409 | A1* | 4/2009 | Johnson et al. | 174/84 R |
| 2009/0130879 | A1* | 5/2009 | Johnson et al. | 439/215 |
| 2009/0134716 | A1* | 5/2009 | Kitamura et al. | 307/149 |
| 2009/0197461 | A1* | 8/2009 | Benoit et al. | 439/535 |
| 2010/0280677 | A1* | 11/2010 | Budike, Jr. | 700/296 |
| 2010/0328852 | A1* | 12/2010 | Johnson et al. | 361/641 |
| 2010/0328853 | A1* | 12/2010 | Johnson et al. | 361/641 |

* cited by examiner

METHOD FOR WIRING DEVICES IN A STRUCTURE USING A WIRELESS NETWORK

FIELD OF THE INVENTION

The invention relates generally to a method for wiring devices in a structure. More particularly, the invention relates to wiring devices in a structure that does not require wires to be run from an electric power source to a device controller.

BACKGROUND OF THE INVENTION

Household devices, such as lighting fixtures, ceiling fans, audio/visual equipment, garage door openers, and other types of devices, are powered by a connection to standard household wiring provided in a home. The standard household wiring connects an electric power source to the household devices. The household devices are controlled by switches that are connected to the electric power source by the standard household wiring. The standard household wiring is also used to connect the switches to the household devices. Thus, wires are needed to connect each of the household devices and the switches to the electric power source.

If multiple switches are desired to control a single household device (e.g., two or three switches control a single lighting fixture), three-way or four-way switches are required to enable independent operation of the household device by each of the switches. Wiring of three-way and four-way switches is difficult. Proper connections must be made between or among each of the switches to enable proper operation of the switches. This is time-consuming for an electrician. If a mistake is made in the wiring, it is often difficult and further time-consuming to determine a cause of a problem. Additionally, the wiring of three-way and four-way switches is expensive, requires a significant amount of wiring, and makes it difficult to provide a dimming feature to a lighting fixture.

SUMMARY OF THE INVENTION

Embodiments of the present invention provide a method for controlling lighting fixtures over a wireless network that includes connecting a junction box to a power source, connecting a lighting fixture to the junction box, establishing a connection over a wireless network between the junction box and a controller, and controlling a function of the lighting fixture by transmitting a signal from the controller to the junction box over the wireless network.

Other embodiments of the present invention provide a system for controlling lighting fixtures of a structure that includes a junction box including a wireless communicating element, and a controller, in wireless communication with the junction box, to control a function of a lighting fixture operably connected to the junction box by transmitting a signal over the wireless network to the junction box.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
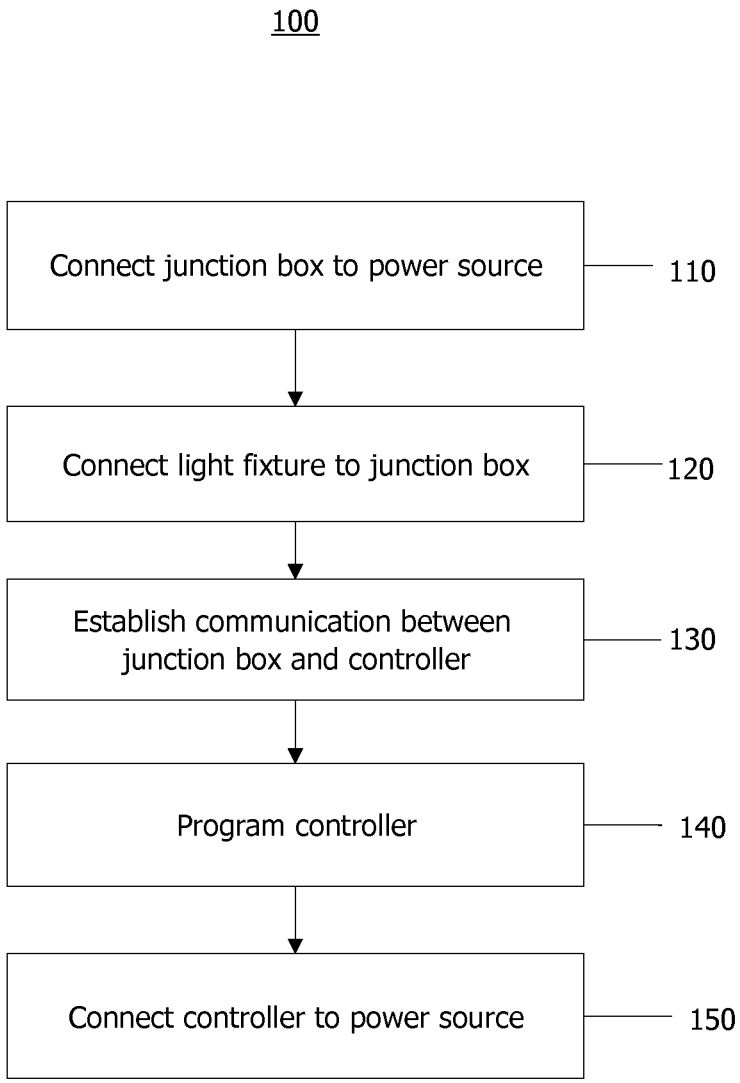
FIG. 1 illustrates a method of wiring lighting fixtures of a structure using a wireless network according to an embodiment of the invention.

FIG. 1 illustrates a method 100 of wiring lighting fixtures of a structure using a wireless network according to one embodiment of the invention. The method 100 includes connecting a junction box of a lighting fixture to a power source, step 110. This typically includes running one or more wires from, for example, a circuit breaker or other power source to the junction box of the lighting fixture. The junction box enables users to control functions of the lighting fixture using a controller that wirelessly communicates signals to the junction box using a wireless network. The wireless network may be, for example, a wireless mesh network such as, for example, a Z-WAVE® network. The junction box may include elements that enable the junction box to be programmed to operate one or more lighting fixtures by altering one or more functions of the lighting fixture. The lighting fixture is connected to the junction box, step 120, using known methods. For example, wires of a ceiling fan that has one or more lights may be connected to the one or more wires that connect the junction box to the power source.

Communication between the junction box and a lighting fixture controller is established in step 130. This may include programming the controller to operate the lighting fixture. Programming of the controller may be achieved by transmitting a signal from the controller to the junction box that enables the junction box to be able to recognize signals transmitted from that controller. Multiple signals may be transmitted between the controller and the junction box to enable users to control one or more functions of the lighting fixture. For example, the signals may identify functions such as on, off, dim 90%, dim 50%, dim 30%, etc. The signals may also identify other functions that the lighting fixture may perform.

Providing wireless communications between the junction box and the controller alleviates a need to run one or more wires from a controller such as, for example, a switch, to the lighting fixture. By not requiring wires to be run from the controller to the lighting fixture, cost savings are achieved because less wire material is needed to wire a structure. Additionally, if a junction box is wired incorrectly, the controller need only be reprogrammed to operate correctly instead of having to rewire the junction box which is time-consuming and may be a trial-and-error type of repair.

The controller may also be programmed to control other lighting fixtures, step 140. The controller may transmit signals to other lighting fixtures as discussed above and control one or more functions or those lighting fixtures.

According to one embodiment of the invention, the controller may be battery operated. According to another embodiment of the invention, the controller may be connected to the power source provided for the structure, step 150. This may include running a wire from the controller to a power outlet provided in the structure. Alternatively, a wire may be run from the controller to the lighting fixture or directly to the power source.

Figure 2:
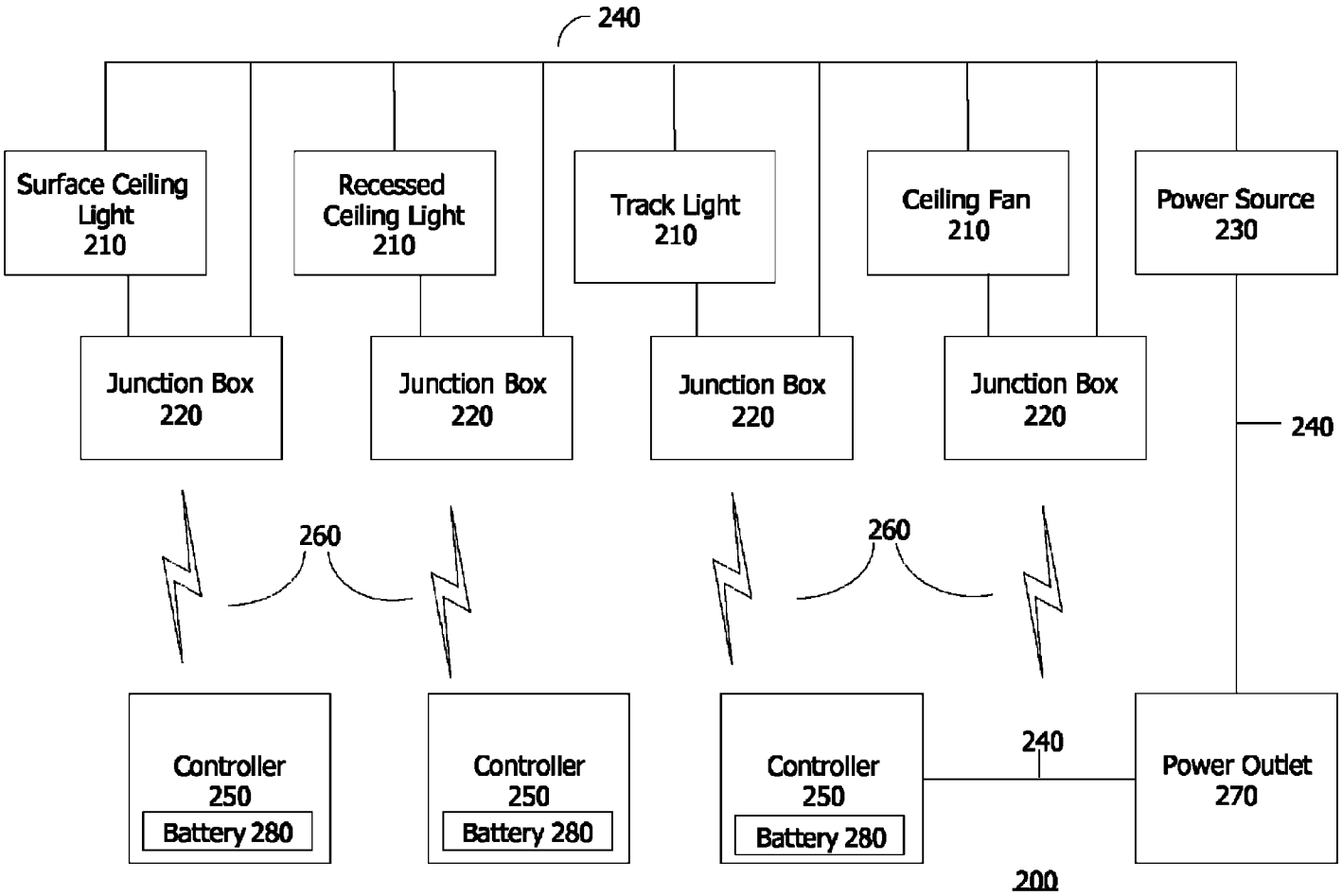
FIG. 2 is an illustration of a wiring system for lighting fixtures of a structure according to an embodiment of the invention.

FIG. 2 is an illustration of a wiring system 200 for lighting fixtures of a structure according to one embodiment of the invention. The wiring system 200 may include one or more lighting fixtures 210. The lighting fixtures 210 may be, for example, surface ceiling lights, recessed ceiling lights, track lights, ceiling fan lights or other types of lights. Each of the lighting fixtures 210 are connected to a junction box 220 using standard wiring 240. The lighting fixtures 210 are also connected to a power source 230 using the standard wiring 240.

The junction boxes 220 are in wireless communication with one or more controllers 250. The wireless communication may be provided over a wireless network 260. The wireless network may be, for example, a wireless mesh network such as a Z-WAVE® network. The junction boxes 220 include one or more elements that enable the junction boxes 220 to wirelessly communicate with one or more controllers 250 (described in further detail below). The controller 250 transmits signals to one or more junction boxes 220 over the wireless network 260 to control one or more functions of the lighting fixtures 210. The functions may be, for example, turning the lighting fixture on or off, dimming the lighting fixture to a desired brightness, or other function.

The controllers 250 may include a battery 280 that supplies power to the controller 250. The controller 250 may also be connected to the power source 230 via, for example, a power outlet 270. The controller 260 may be connected to the power outlet 270 using the standard wiring 240. Alternatively, the controller 250 may be connected to the lighting fixture 210 or directly to the power source 230 using the standard wiring 240 as is known.

Figure 3:
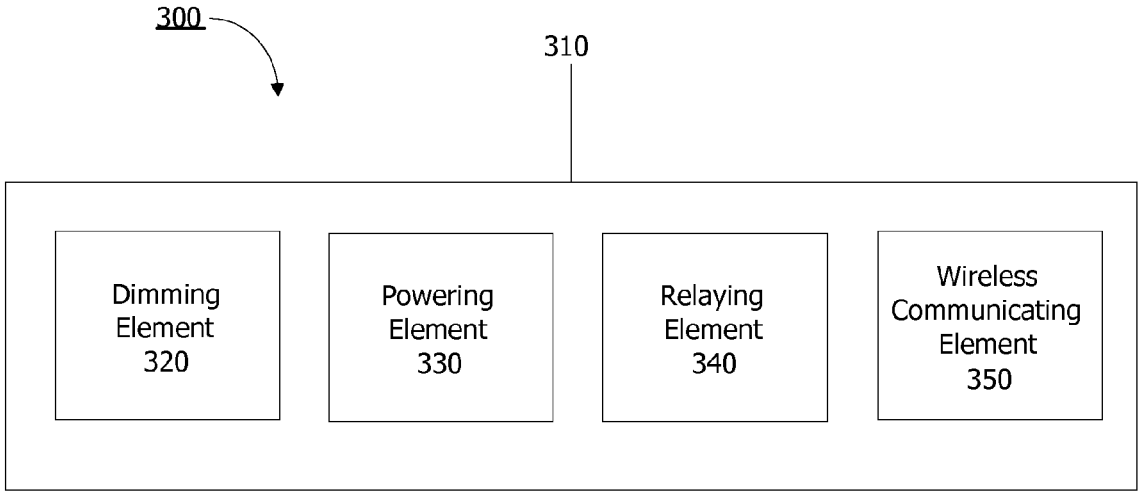
FIG. 3 is an illustration of a junction box according to an embodiment of the invention.

FIG. 3 illustrates a junction box 300 for a lighting fixture according to one embodiment of the invention. The junction box 300 includes a housing 310. The housing 310 may be detachable from the lighting fixture to enable replacement of the junction box 300, an element of the junction box, or for another reason.

The junction box 300 may include a dimming element 320, a powering element 330, a relaying element 340, and a wireless communicating element 350. The dimming element 320 may enable a controller to dim the lighting fixture to a desired intensity. The powering 330 enables the controller to power the lighting fixture on and off. The relaying element 340 may be used to relay signals transmitted from a controller to another controller or a lighting fixture. The wireless communicating element 350 may be used to enable the junction box 300 to wireless communicate with one or more controllers 260. The wireless communicating element 350 may be, for example, a module that operates using the Z-WAVE® standard or another standard or protocol.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method for controlling lighting fixtures over a wireless network, comprising:

connecting elements included in a junction box to a power source and a lighting fixture, the elements enabling dimming and/or powering of the lighting fixture and communication via the wireless network;

connecting the lighting fixture to the elements included in the junction box;

wiring a three-way switch or a four-way switch to the elements included in the junction box;

establishing a connection over the wireless network between the elements included in the junction box and a controller for controlling dimming and/or powering of the lighting fixture;

receiving programming to reconfigure the controller to operate correctly when the elements included in the junction box are wired incorrectly to the switch; and controlling a dimming and/or powering function of the lighting fixture by transmitting a signal from the controller to the junction box over the wireless network.

2. The method of claim 1, wherein the controller is battery operated or connected to a power outlet of a structure.

3. The method of claim 1, wherein the wireless network comprises a wireless mesh network.

4. The method of claim 1, wherein the junction box further includes a relaying element enabling relaying of the transmitted signal from the controller to another controller or another lighting fixture.

5. The method of claim 4, wherein the junction box comprises a removable housing for the elements included in the junction box.

6. The method of claim 1, further comprising programming the controller.

7. A system for controlling lighting fixtures of a structure prepared by a process, the process comprising:

connecting elements included in a junction box to a power source and a lighting fixture, the elements enabling dimming and/or powering of the lighting fixture and communication via the wireless network;

connecting the lighting fixture to the junction box;

wiring a three-way switch or a four-way switch to the elements included in the junction box;

establishing a connection over the wireless network between the elements included in the junction box and a controller for controlling dimming and/or powering of the lighting fixture;

receiving programming to reconfigure the controller to operate correctly when the elements included in the junction box are wired incorrectly to the switch; and controlling a dimming and/or powering function of the lighting fixture by transmitting a signal from the controller to the junction box over the wireless network.

8. The system of claim 7, wherein the controller is battery operated or connected to a power outlet of the structure.

9. The system of claim 7, wherein the wireless network comprises a wireless mesh network.

10. The system of claim 7, wherein the junction box further includes a relaying element enabling relaying of the transmitted signal from the controller to another controller or another lighting fixture.

11. The system of claim 10, wherein the junction box comprises a removable housing for the elements included in the junction box.

12. The system of claim 7, further comprising programming the controller.

13. A system for controlling lighting fixtures of a structure over a wireless network, comprising:

elements included in a junction box, the elements enabling dimming and/or powering of the lighting fixture and communication over the wireless network via a wireless communicating element; and a controller, configured for wireless communication with the wireless communicating element, to control a dimming and/or powering function of the lighting fixture operably connected to the elements in junction box by transmitting a signal over the wireless network to the elements of the junction box, wherein the elements included in the junction box are wired to a three-way switch or a four-way switch, and the controller is configured to receive programming to reconfigure the controller to operate correctly when the elements included in the junction box are wired incorrectly to the switch.

14. The system of claim 13, wherein the controller is battery operated or connected to a power outlet of the structure.

15. The system of claim 13, wherein the wireless network comprises a wireless mesh network.

16. The system of claim 13, wherein the elements included in the junction box further includes a relaying element enabling relaying the transmitted signal from the controller to another controller or another lighting fixture.

17. The system of claim 16, wherein the junction box comprises a removable housing for the elements included in the junction box.

* * * * *